US005799584A

United States Patent [19]

Campbell

[11] Patent Number: 5,799,584

[45] Date of Patent: Sep. 1, 1998

[54] SKID RUNNERS

[76] Inventor: Gilles Campbell, 1300 Grenade Street, Chambly, Québec, Canada, J3L 3C1

[21] Appl. No.: 563,037

[22] Filed: Nov. 27, 1995

[51] Int. Cl.[6] ..... B65D 19/00

[52] U.S. Cl. ..... 108/51.3

[58] Field of Search ..... 108/51.3, 51.1

[56] References Cited

U.S. PATENT DOCUMENTS

| | | | |
|---|---|---|---|
| 2,445,914 | 8/1948 | Fallert et al. | 108/51.3 |
| 2,957,668 | 10/1960 | Norquiss et al. | 108/51.3 |
| 3,434,435 | 3/1969 | Achermann et al. | 108/51.3 |

FOREIGN PATENT DOCUMENTS

| | | | |
|---|---|---|---|
| 2127773 | 4/1984 | United Kingdom | 108/51.3 |

*Primary Examiner*—Peter M. Cuomo

*Assistant Examiner*—Gerard A. Anderson

*Attorney, Agent, or Firm*—François Martineau

[57] ABSTRACT

This runner is for disposable skids, pallets and the like load-bearing platforms which are entirely made of corrugated cardboard. It consists of an elongated tubular member made of double face corrugated cardboard and secured under the skid panel and including a top web, a base web and two side walls. A reinforcement strip is located within the member; this strip has an undulated shape and a straight cross-section. It is built up of several laminations of single face corrugated cardboard with the corrugations vertically disposed. It is substantially parallel to the walls, its top and bottom edges secured to the top and bottom webs respectively and its opposite rounded crests in alternate contact with the walls and secured to the latter spacedly from one another longitudinally of the member. The strip only partially fills the volume of the elongated member. The pitch of the sinusoidal strip can be shortened in selected areas to further reinforce the runner in these areas.

8 Claims, 3 Drawing Sheets

SKID RUNNERS

FIELD OF THE INVENTION

The present invention relates to runners for disposable skids made of corrugated cardboard.

BACKGROUND OF THE INVENTION

It is known to provide disposable skids or pallets which are entirely made of corrugated cardboard. The skid panels are normally made of two laminations, each of double-face corrugations with the corrugations of the two panels being cris-crossed. The runners of one type of such known skids consist simply of a stack of several flat strips of double-face corrugated cardboard which are glued together, the top strip being glued flat to the underside of the panel. Such runners have sufficient strength for the specified load bearing capacity of the skid but could be improved as to their weight and cost. U.S. Pat. No. 2,446,914 dated Aug. 10, 1948, inventors: Fallert and Al, entitled "Pallet Construction" and U.S. Pat. No. 2,957,668 dated Oct. 25, 1960, inventors Norquist et Al, entitled "Materials Handling Pallet and Method of Making Pallets", describe attempts to such improvements by forming a tubular corrugated cardboard runner in which is inserted a reinforcing strip made of double face corrugations and bent in zig zag fashion to form longitudinally spaced V shaped ribs. Such reinforcement strips can only be formed by sharply folding and cutting flat stock of double-face corrugated sheet which are necessarily supplied in panels of small length.

OBJECTS OF THE INVENTION

The main object of the present invention resides in the provision of runners for disposable skids and the like bearing platforms in which their weight and cost are reduced compared to conventional runner of corrugated cardboard and of comparable strength.

Another object of the present invention resides in the provision of runners of the character described which are designed to be manufactured by a continuous forming, assembling and cutting machine.

SUMMARY OF THE INVENTION

In accordance with the present invention, there is provided a runner for skids and the like load bearing platforms which comprises an elongated hollow member made of double face corrugated cardboard and including a base web and two side walls spaced from each other, and a reinforcement strip built up of several single face corrugated laminations glued to one another. Said strip is located in said member and only partially fills the same, this strip having parallel top and bottom edges, a sinusoidal shape and a straight cross-section substantially parallel to the walls, and with the corrugations disposed vertically the strip bottom edge bearing on the base web, the crests of the sinusoidal strip being rounded and in alternate contact with and secured to the walls spacedly from one another longitudinally of the member, the strip and walls have substantially coplanar top edges.

There are preferably four such laminations, their corrugation form C flutes, namely they have a depth and a pitch of about 3/16 of an inch.

Preferably, the cardboard constituting the elongated member consists of a double wall, double face corrugations.

Preferably, the member is four-sided and one side is extended by a flap which laps and is secured to another side.

The pitch of the strip laminations can be shortened in designated zones to reinforce the runner at said zones.

The runners are designed to be glued to one main face of the quadrangular panel of a skid, said panel itself being made of two laminations of double face corrugated cardboard glued together, the panel corrugations being cris-crossed.

BRIEF DESCRIPTION OF THE DRAWINGS

In the annexed drawings, like reference characters indicate like elements throughout.

DETAILED DESCRIPTION OF THE PREFERRED EMBODIMENT

The skid S is of the disposable type being formed of paper products and more particularly of corrugated cardboard. The skid shown has a top panel 10 of square or rectangular shape and fitted with three parallel runners 12 fixed to the underface of the top panel 10 and parallel to two parallel sides of the quadrangular panel 10.

Figure 7:
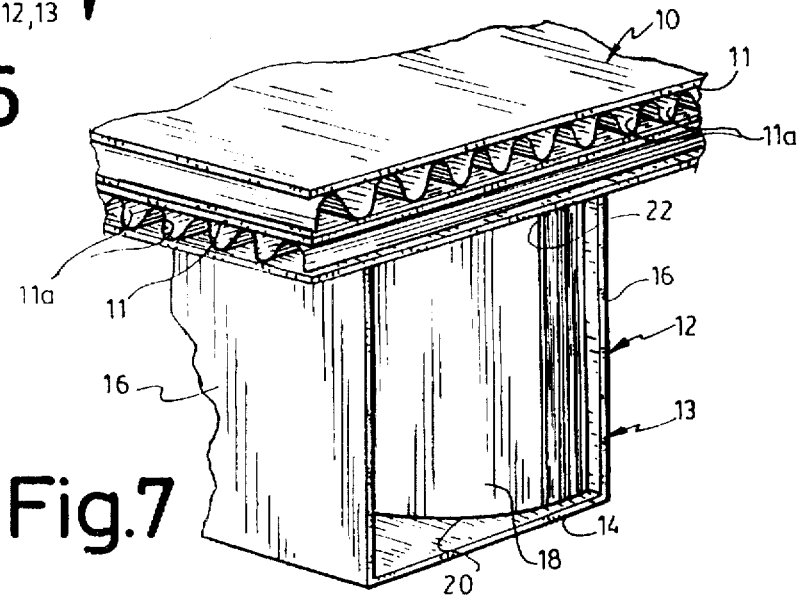
FIG. 7 is partial perspective view of one corner of the skid.

The top panel 10 is normally made of two laminations 11, each of double-faced, corrugations 11*a*, the corrugations being criss-crossed (see FIG. 7).

Each runner 12 comprises an elongated member 13 of U-shaped cross-section providing a base web 14 and two spaced parallel side walls 16.

A strip 18 is located within the volume defined within the runner 12 and only partially fills said volume. The strip 18 has a sinusoidal shape defining rounded crests 28 and two parallel edges, namely a bottom edge 20 and a top edge 22. The strip has a flat cross-section and is laid on edge, bottom edge 20 and top edge 22 bearing on base web 14 and against the under side of panel 10 respectively. Strip 18 is built-up of several laminations 19 of single face corrugated cardboard glued together. Preferably there are two intermediate laminations sandwiched between two outermost laminations. Each lamination is composed of a plane lamina or face 24 and of a corrugated lamina or corrugations 26. The face 24 of anyone lamination, except one outermost lamination, adheres to the corrugations 26 of an adjacent lamination. The crests 28 adhere to the walls 16 spacedly from one another longitudinally of the member or runner 12.

Preferably, the sinusoidal strip 18 has a pitch P of about 4 inches, the inside width of the runner 12 being about 3 to 4 inches. Preferably corrugations 26 form corrugations, namely they have a depth and a pitch of about 3/16 of an inch. The top edge 22 of strip 18 and the top edges of side walls 16 are coplanar and glued to the underside of panel 10. Alternately, the top edges of side walls 16 can be secured to the underside of panel 10 by an adhesive tape.

Figure 8:
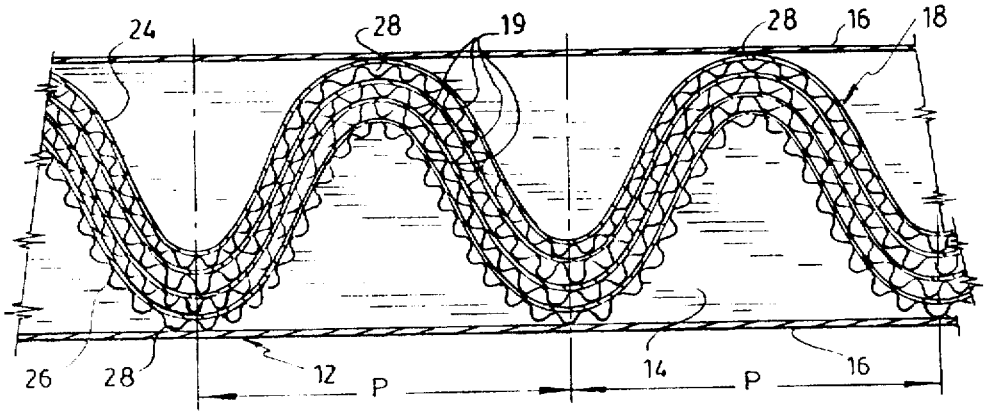
FIG. 8 is partial plan section taken along line 8—8 of the runner of FIG. 5.

Looking at FIG. 8, it is clear that the strip only partially fills the inside volume of runner 12 and therefore the entire runner is made of much less cardboard and consequently is lighter and less expensive to make than conventional runners formed of a stack of corrugated laminations secured flat against the underside of panel 10. Yet, since reinforcement strip 18 is formed of several laminations of single face corrugated cardboard glued to one another, each lamination is flexible and can be easily bent to the intended sinusoidal shape with rounded crests 28. The crests provide a good contact area to be glued to side walls 16 of runner 12. Therefore, runner 12 has a considerable strength against flexion and also against torsion. In fact, tests have proven that the runners of the invention have resistance to flexion and to torsion sufficient to resist the load and impact forces which conventional corrugated cardboard disposable skids are designed to meet.

Figure 1:
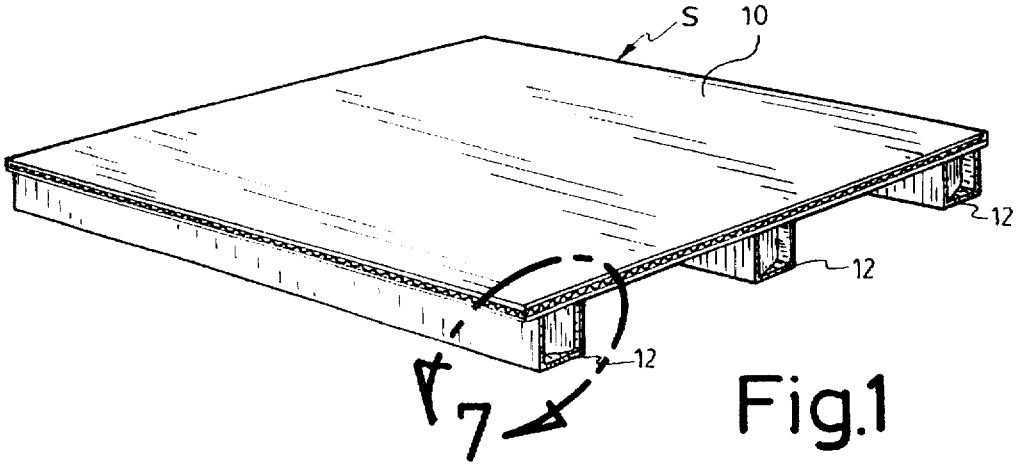
FIG. 1 is a perspective view of the disposable skid fitted with runners in accordance with the invention.
Figure 2:
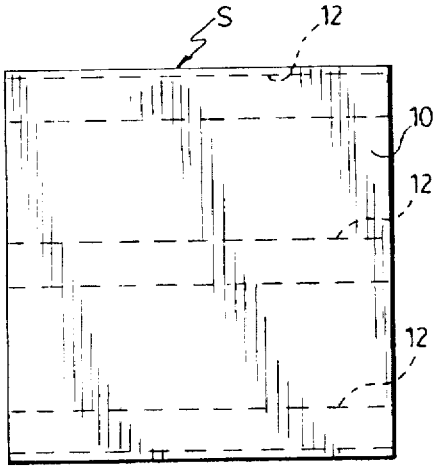
FIG. 2 is a top plan view of the skid.
Figure 3:
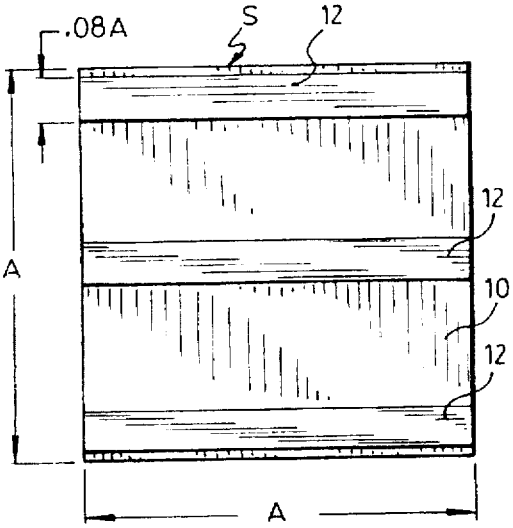
FIG. 3 is a bottom plan view of the skid.
Figure 4:
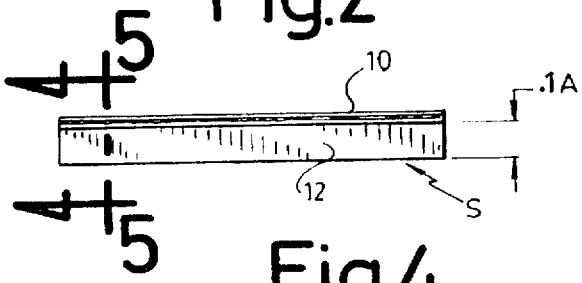
FIG. 4 is a side elevation of the same.
Figure 5:
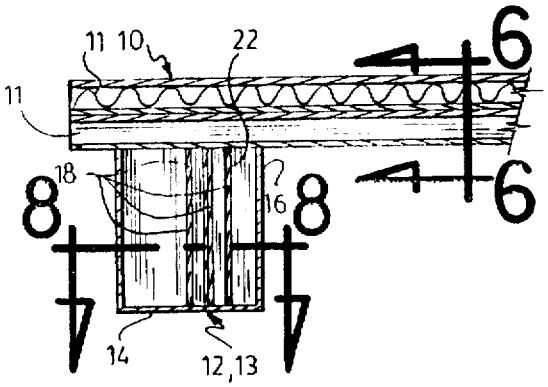
FIG. 5 is a partial cross-section taken along line 5—5 of FIG. 4.
Figure 6:
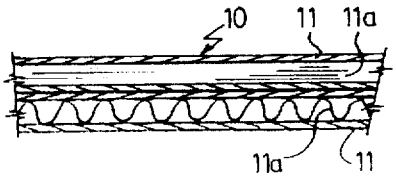
FIG. 6 is partial cross-section taken along line 6—6 of FIG. 5.
Figure 9:
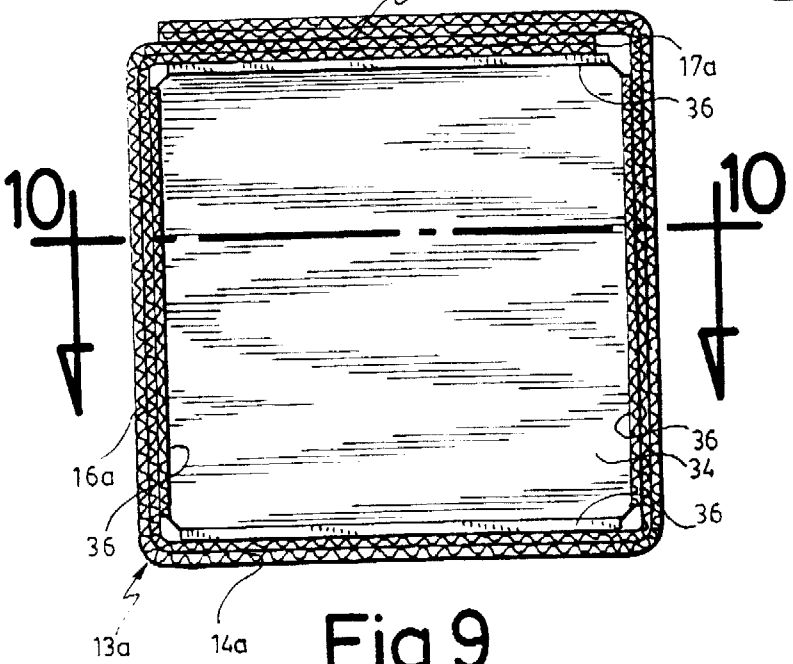
FIG. 9 is a cross-section of a modified preferred runner.

Instead of thick, non-corrugated cardboard as shown in FIGS. 5, 7 and 8, the walls 16 are preferably made of corrugated cardboard, more particularly of a double wall corrugated cardboard, which is two corrugations separated by an intermediate face and covered by two outer faces as shown in FIG. 9.

Preferably, elongated member 13 forms a complete four-sided tube 13*a* as shown in FIG. 9 which includes a base web 14*a*, side walls 16*a* and a top web 17*a*. Preferably, a flap 30 extends from one side wall 16*a* and laps and is secured to top web 17*a*. In this case, flap 30 is secured flat to the underside of panel 10 while top edge 22 of strip 18 is secured to top web 17*a*.

Preferably, the ends of the members 13*a* are closed by end caps 32, also made of double face corrugated cardboard and defining a central square 34 and for side flanges 36 which are folded and glued to the inside surface of the members 13*a*. Thus, the runner 12 forms a very rigid element and has a large gluing surface to be glued or stapled to the top panel 10.

Figure 10:
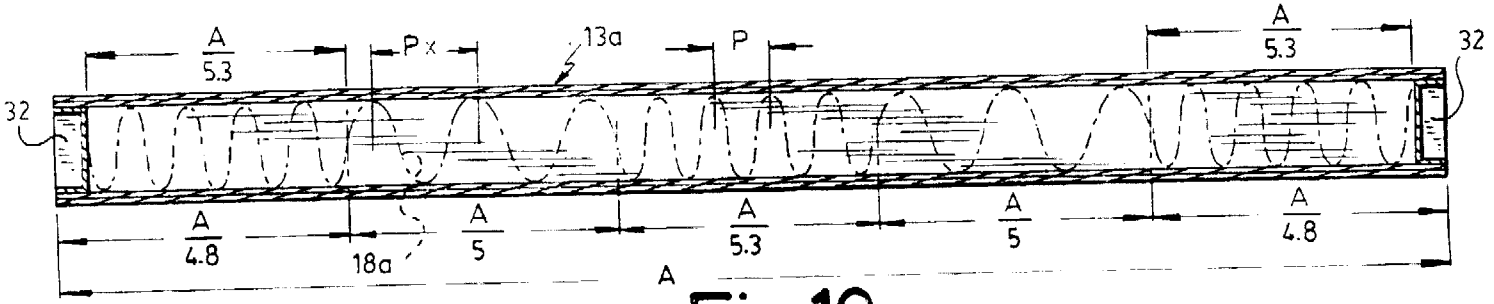
FIG. 10 is a plan section taken along line 10—10 of FIG. 9.
Figure 11:
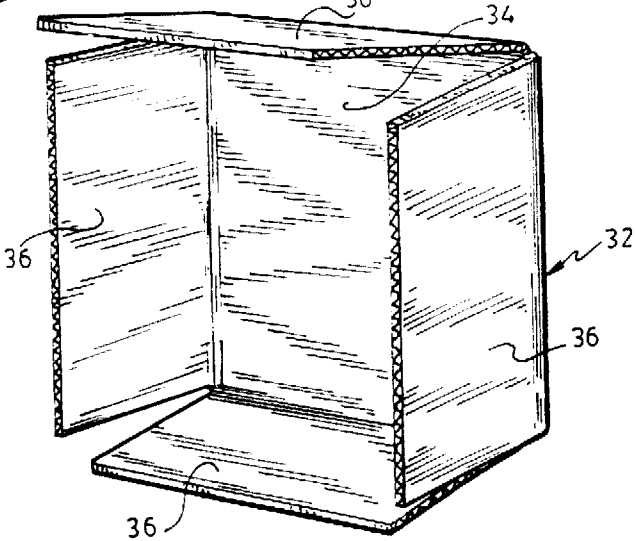
FIG. 11 is a perspective view of the end cap shown in FIGS. 9 and 10.

FIG. 10 shows that the pitch P of the undulations of reinforcing strip 18*a* are shortened in selected zones of runner 12 to further reinforce said zones. For instance, when skid S is intended to be supported, while loaded, on a storage rack comprising rails supporting only the middle and the two ends of runners 12, then strip 18 is bunched in those zones. FIG. 10 shows, as an example, a runner 12 of length A in which the normal pitch Px is shortened to pitch P in a central zone and two end zones of respective length A/5.3.

I claim:

1. A runner made of corrugated cardboard and for skids and the like load bearing platforms comprising an elongated hollow member which includes a base web and two side walls spaced from each other and normal to said base web, said side walls having coplanar top edges, a reinforcement strip located in said member and only partially filling the same, said strip having a sinusoidal shape with rounded crests and a straight cross-section substantially parallel to said side walls, said strip having parallel top and bottom edges, said bottom edge bearing on said base web, said top edge of said strip being substantially coplanar with said top edges of said side walls, said reinforcing strip built-up of several laminations of single face corrugated cardboard glued together with the corrugations normal to said base web, said rounded crests in alternate contact with said side walls and secured to said side walls spacedly from one another longitudinally of said member.

2. A runner as defined in claim 1, wherein said member is tubular and includes a top web, the top edge of said strip supporting said top web.

3. A runner as defined in claim 2, wherein said top and bottom webs and said two side walls form four sides of said tubular member, one of said sides being extended by a flap which laps and is secured to another one of said sides.

4. A runner as defined in claim 2, wherein the undulations forming the undulated shape of said strip have a shortened pitch in selected areas of said member longitudinally of the same.

5. A runner as defined in claim 2, further including caps closing the ends of said tubular member.

6. A runner as defined in claim 1, wherein said laminations include two outermost laminations and wherein the face of each lamination except one outermost lamination adheres to the corrugations of an adjacent lamination and the face of said one outermost lamination and the corrugations of the other outermost lamination adhere to said side walls at said rounded crests.

7. A runner as defined in claim 6, wherein the corrugations of said laminations have a pitch and a depth of about 3/16".

8. A runner as defined in claim 6, wherein the cardboard forming said member is double face corrugated cardboard.

* * * * *